US011189969B2

(12) United States Patent
Soefker

(10) Patent No.: US 11,189,969 B2
(45) Date of Patent: Nov. 30, 2021

(54) PLUG-IN CONNECTOR SYSTEM WITH PLURAL TWO-PART ENCODING DEVICES THAT ARE ROTATABLE TO DISCRETE POSITIONS

(71) Applicant: Phoenix Contact GmbH & Co. KG, Blomberg (DE)

(72) Inventor: Joerg Soefker, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/872,393

(22) Filed: May 12, 2020

(65) Prior Publication Data

US 2020/0366032 A1 Nov. 19, 2020

(30) Foreign Application Priority Data

May 14, 2019 (DE) ..... 102019112532.4

(51) Int. Cl.
*H01R 13/645* (2006.01)
*H01R 13/627* (2006.01)

(52) U.S. Cl.
CPC ..... *H01R 13/645* (2013.01); *H01R 13/6271* (2013.01); *H01R 13/6453* (2013.01)

(58) Field of Classification Search
CPC .. H01R 13/645; H01R 13/6271; H01R 13/64; H01R 13/6453; H01R 13/6456
USPC ..... 439/680, 681
See application file for complete search history.

(56) References Cited

U.S. PATENT DOCUMENTS 3,491,330 A * 1/1970 Barnhart ..... H01R 13/6453 439/681
4,032,213 A * 6/1977 Snyder ..... H01R 13/6453 439/681
6,302,745 B1 * 10/2001 Landis ..... H01R 13/6453 439/681
6,814,625 B2 * 11/2004 Richmond ..... H01R 13/6453 439/157

(Continued)

FOREIGN PATENT DOCUMENTS

DE 102007052606 B3 6/2009
EP 2091108 B1 4/2016
GB 2262001 A * 6/1993 ..... H01R 13/645

*Primary Examiner* — Travis S Chambers
(74) *Attorney, Agent, or Firm* — Leydig, Voit & Mayer, Ltd.

(57) ABSTRACT

A plug-in connector system includes: a first plug-in connector part and a second plug-in connector part, which are connectable to one another in a plug-in manner along a plug-in direction; and an encoding device having a first encoding part connectable to the first plug-in connector part and a second encoding part connectable to the second plug-in connector part. The first encoding part and the second encoding part are arrangeable together on the second plug-in connector in a pre-assembly position and the first encoding part is connectable with the first plug-in connector part during connecting of the first plug-in connector part and the second plug-in connector part and to remain on the first plug-in connector part during detaching of the first plug-in connector part and the second plug-in connector part from each other. One of the second plug-in connector part and the second encoding part has a locking section.

14 Claims, 13 Drawing Sheets

(56) References Cited

U.S. PATENT DOCUMENTS

| | | | | |
|---|---|---|---|---|
| 2009/0209140 | A1* | 8/2009 | Heggemann ..... | H01R 13/6453<br>439/680 |
| 2011/0177715 | A1 | 7/2011 | Buck et al. | |

* cited by examiner

PLUG-IN CONNECTOR SYSTEM WITH PLURAL TWO-PART ENCODING DEVICES THAT ARE ROTATABLE TO DISCRETE POSITIONS

CROSS-REFERENCE TO PRIOR APPLICATIONS

Priority is claimed to German Patent Application No. DE 10 2019 112 532.4, filed on May 14, 2019, the entire disclosure of which is hereby incorporated by reference herein.

FIELD

The invention relates to a plug-in connector system, to an electrical device, and to a method for encoding a plug-in connector system.

BACKGROUND

Such a plug-in connector system comprises a first plug-in connector part and a second plug-in connector part which can be connected together in a plug-in manner along a plug-in direction. The connector system also includes an encoding device having a first encoding part connectable to the first plug-in connector part and a second encoding part connectable to the second plug-in connector part. The first encoding part and the second encoding part can be arranged together on the second plug-in connector part in a pre-assembly position. The first encoding part is adapted to connect to the first plug-in connector part when the first plug-in connector part and the second plug-in connector part are connected together, and to remain on the first plug-in connector part when the first plug-in connector part and the second plug-in connector part are detached from one another.

In a plug-in connector system known from EP 2 091 108 B1, encoding parts of an encoding device for pre-assembly can be arranged together on an associated plug-in connector part by connecting an encoding part of the encoding device to the plug-in connector part in a latching manner via spring arms. In a pre-assembly position, another encoding part is held on the encoding part and through it on the associated plug-in connector part. If the plug-in connector part together with the encoding device arranged thereon is connected to another plug-in connector part, the further encoding part comes into contact with this other plug-in connector part and remains on the other plug-in connector part when the plug-in connector parts are detached from one another. After the plug-in connector parts have been detached from one another again, an encoding is thus produced on the plug-in connector parts in that one encoding part comes to rest on one plug-in connector part and the other encoding part comes to rest on the other plug-in connector part. By virtue of the fact that the encoding parts can be joined together in exactly one position, an encoding is created in this way on the plug-in connector parts which ensures that only specified plug-in connector parts that are assigned to one another can be connected to one another.

In existing encoding devices, the number of encoding possibilities can be limited. Thus, there may not be enough distinguishing possibilities if there are a plurality of pairs of plug-in connector parts in order to clearly distinguish all pairs of plug-in connector parts from one another.

SUMMARY

In an embodiment, the present invention provides a plug-in connector system, comprising: a first plug-in connector part and a second plug-in connector part, which are connectable to one another in a plug-in manner along a plug-in direction; and an encoding device having a first encoding part connectable to the first plug-in connector part and a second encoding part connectable to the second plug-in connector part, wherein the first encoding part and the second encoding part are arrangeable together on the second plug-in connector in a pre-assembly position and the first encoding part is configured to connect with the first plug-in connector part during connecting of the first plug-in connector part and the second plug-in connector part and to remain on the first plug-in connector part during detaching of the first plug-in connector part and the second plug-in connector part from each other, wherein one of the second plug-in connector part and the second encoding part has a locking section and an insertion opening and an other of the second plug-in connector part and the second encoding part has a locking element, and wherein for connecting the second encoding part to the second plug-in connector part, the locking element is guidable through the insertion opening along the plug-in direction and the locking element is configured to be brought into form-fitting engagement with the locking section by rotation of the second encoding part and the second plug-in connector part relative to one another.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
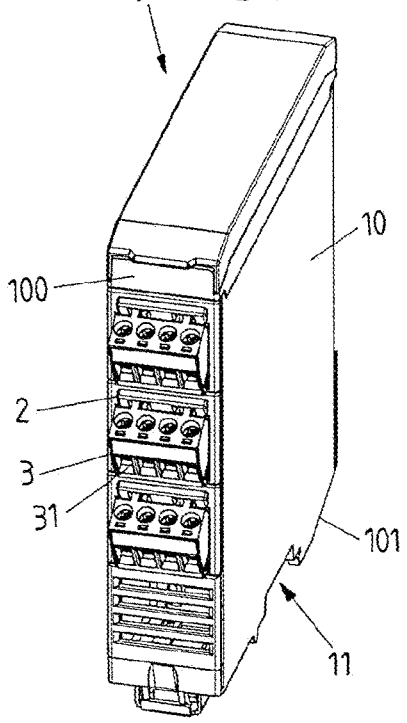
FIG. 1 a view of an exemplary embodiment of an electrical device having plug-in connector parts disposed thereon.

In an embodiment, the present invention provides a plug-in connector system which makes it possible to provide an encoding on plug-in connector parts in a simple manner with a potentially comparatively large number of encoding possibilities via the encoding device.

Accordingly, in the plug-in connector system, one of the second plug-in connector part and the second encoding part has a locking section and an insertion opening, and the other of the second plug-in connector part and the second encoding part has a locking element, wherein for connecting the second encoding part and the second plug-in connector part, the locking element can be guided through the insertion opening and the locking element can be brought into form-fitting engagement with the locking section by rotation of the second encoding part and the second plug-in connector part relative to one another.

This is based on fixing the second encoding part to the associated second plug-in connector part via a connection in the manner of a bayonet connector. In this case, the second encoding part should be firmly held on the associated second plug-in connector part when in the connected position, in particular along the plug-in direction, with the second encoding part preferably also being secured in its rotational position relative to the second plug-in connector part.

To produce the encoding, the encoding device is arranged on the second plug-in connector part. For this purpose, the second encoding part—together with the first encoding part arranged on the second encoding part—is connected to the second plug-in connector part in that the locking element is guided through the insertion opening and is form-fittingly engaged with the locking section by rotation of the second encoding part relative to the second plug-in connector part. Through the engagement of the locking element with the locking section, the second encoding part is thus fastened to the second plug-in connector part, so that the second encoding part is arranged in a fixed position on the second plug-in connector part.

Now, the second plug-in connector part is connected in a plug-in manner to the first plug-in connector part, with a first encoding part located on the second encoding part in the pre-assembly position. When connecting, the first encoding part interacts with the assigned first plug-in connector part in such a way that, when the first plug-in connector part and the second plug-in connector part are detached from each other again, the first encoding part remains on the first plug-in connector part and thus—when the plug-in connector parts are detached—the first encoding part comes to rest on the first plug-in connector part and the second encoding part comes to rest on the second plug-in connector part.

The encoding parts thus provide encoding in that, when the plug-in connector parts are connected again, the encoding parts have to be brought together and joined to one another in the intended manner. Only plug-in connector parts with a matching encoding defined on the basis of the position of the encoding parts can be joined to one another, so that plug-in connector parts with incorrect encoding can be prevented from being connected to one another by means of the encoding parts.

The encoding is simple to produce by means of the encoding device. By virtue of the fact that the second encoding part can be arranged in different positions on the associated second plug-in connector part, a variable encoding with a comparatively large number of different encoding possibilities can also be provided.

In one embodiment, the locking section extends in a ring shape, wherein the insertion opening interrupts the locking section at one location when viewed along a circumferential direction about the plug-in direction. The locking section can, for example, be formed circumferentially on the second encoding part and is interrupted by the insertion opening in such a way that the locking element formed on the second plug-in connector part in this case can be moved past the locking section through the insertion opening in order to establish a form-fitting engagement between the locking element and the locking section by subsequent rotation of the second encoding part relative to the second plug-in connector part and thereby to fix the second encoding part to the second plug-in connector part.

In one embodiment, one of the parts, that is to say the second plug-in connector part or the second encoding part, has a connection shaft which is, for example, cylindrically shaped and extends along the plug-in direction. In this case, the respective other part, that is to say the second encoding part or the second plug-in connector part, has a connection opening into which the connection shaft can be inserted in order to arrange the second encoding part on the second plug-in connector part.

The locking section may extend, for example, on the connection shaft in that the locking section is formed circumferentially on the connection shaft and protrudes from the connection shaft radially with respect to the plug-in direction. If the connection shaft is a component of the second encoding part, the locking section is thus associated with the second encoding part. Alternatively, however, the connection shaft may also be a component of the second plug-in connector part and may be introduced into a connection opening of the second encoding part. In this case, the locking section is part of the second plug-in connector part.

A connection in the manner of a bayonet connector is created by the locking section interrupted by the insertion opening on one of the parts and the locking element on the other of the parts. In this case, both the locking section and the locking element can be rigidly formed on the associated component in each case. To connect, the locking element is guided through the insertion opening interrupting the locking section, and the locking element is brought into form-fitting engagement with the locking section by subsequent rotation.

It is also conceivable and possible here to provide more than one locking element, which can accordingly be passed through more than one insertion opening interrupting the locking section. In this way, the connection between the second encoding part and the second plug-in connector part can be secured and fixed at a plurality of locations.

In one embodiment, the second encoding part has a first latching device, while the second plug-in connector part comprises a second latching device. The first latching device and the second latching device together define a plurality of discrete rotational positions which are angularly spaced apart from one another about the plug-in direction, in which positions the second encoding part and the second plug-in connector part are held latched to one another. The latching devices thus predefine rotational positions in which the second encoding part can be brought to the second plug-in connector part. These rotational positions define different encoding positions for providing encoding between the plug-in connector parts.

The first latching device can be formed, for example, by one or more latching projections which project radially from a connection shaft of the second encoding part and are angularly spaced apart from one another. In this case, the second latching device on the second plug-in connector part can be formed, for example, by one or more latching pockets angularly spaced apart from one another, for example on a wall surrounding a connection opening of the second connector part. Alternatively, the first latching device can be formed by one or more latching pockets, while the second latching device is formed by one or more latching projections. A combination of latching pockets and latching projections on each latching device is also conceivable and possible.

In a predetermined rotational position corresponding to an encoding position, the latching devices engage in a latching manner with one another in such a way that the second encoding part and the second plug-in connector part cannot be easily rotated out of the rotational position, in any case not without exceeding a certain threshold force. The second encoding part can thus be brought into different, defined positions relative to the second plug-in connector part, so that a desired encoding can be set as a function of the position of the second encoding part.

In this case, it can be provided that the first encoding part and the second encoding part can (exclusively) be joined to one another along the plug-in direction in a predetermined angular position relative to one another. The position of the second encoding part on the second plug-in connector part thus defines the position of the first encoding part in which the first encoding part can be joined to the second encoding part. Only when the first encoding part is in a matching position assigned to the second encoding part—after the encoding has been produced—can the plug-in connector parts be connected to one another along the plug-in direction without being hindered by the encoding parts.

In one embodiment, one of the encoding parts has an encoding shaft, while the other of the encoding parts forms an encoding opening. The encoding shaft can be joined to the encoding opening along the plug-in direction (exclusively) in a predetermined angular position, due for example to the fact that the encoding shaft and the encoding opening have an asymmetrical shape, for example a D shape or a wedge shape, in cross-section transverse to the plug-in direction. The encoding shaft and the encoding opening can thus exclusively be joined together in a specified position. Thus, if the first encoding part and the second encoding part have no matching positions with respect to one another, the encoding shaft and the encoding opening prevent the encoding parts from being joined to one another.

In one embodiment, the encoding shaft has at least one fitting section with an interference fit with the encoding opening. Such a fitting section can be formed, for example, by a ridge extending axially on the outside of the encoding shaft which has an interference fit with the encoding opening and thus deforms when the encoding shaft is joined to the encoding opening. Using such a fitting section, a frictional connection between the encoding shaft and the encoding opening can be achieved which secures the first encoding part and the second encoding part axially to one another, in particular in their pre-assembly position.

In one embodiment, the first encoding part has a first collar with at least one first encoding element formed thereon. On the other hand, a second collar with at least one second encoding element formed thereon is formed on the second encoding part. The first encoding element and the second encoding element can be joined together along the plug-in direction in a predetermined angular position, so that a (further) encoding between the encoding parts is provided via the encoding elements.

The first encoding element can be embodied, for example, as an encoding projection which can be brought into engagement with an associated second encoding element in the form of an encoding recess. Conversely, the first encoding element can also form an encoding recess which can be joined to an associated second encoding element in the form of an encoding projection. The encoding elements are arranged asymmetrically around the plug-in direction on the first collar and the second collar, so that the encoding elements together define a (single) rotational position of the encoding parts relative to one another in which the encoding parts can be joined to one another.

In one embodiment, the first encoding part has at least one latching element for a latching connection to the first plug-in connector part. To produce the encoding, the first encoding part is first arranged together with the second encoding part on the second plug-in connector part. When the plug-in connector parts are first connected to one another, the first encoding part then engages with the first plug-in connector part, so that the first encoding part remains on the first plug-in connector part and thus the encoding is provided by the encoding parts on the different plug-in connector parts. The connection of the first encoding part to the assigned first plug-in connector part can take place in a latching manner in that one or more latching elements of the first encoding part engage form-fittingly with the first plug-in connector part in such a way that the first encoding part is firmly and durably connected to the first plug-in connector part along the plug-in direction.

For example, in one embodiment, the first encoding part can have an engagement section which can be brought into engagement axially along the plug-in direction with an associated receiving opening of the first plug-in connector part. Here, the at least one latching element can be formed on the engagement section transversely to the plug-in direction, so that, in a connected position, the at least one latching element engages behind an edge of the receiving opening of the first plug-in connector part, for example, and thus the first encoding part is fixed to the first plug-in connector part.

In one embodiment, one of the plug-in connector parts, for example the second plug-in connector part, has at least one plug-in section with an electrical contact element arranged thereon. The at least one plug-in section can be connected in a plug-in manner along the plug-in direction to an associated plug-in opening of the other plug-in connector part, so that the electrical contact element of the plug-in section is electrically contacted with an electrical contact element of the plug-in opening and thus an electrical connection is established between the plug-in connector parts. On each plug-in connector part, for example, multiple plug-in sections can be formed in series which can be connected with multiple plug-in openings formed in series on the respective other connector. In this way, multipolar electrical contacting between the plug-in connector parts can be produced.

An electrical device comprises a plug-in connector system as described above. Such an electrical device may, for example, have a housing with a fastening device formed therein for arranging the electrical device on a support rail. In this way, the electrical device can be combined in particular with other electrical devices on a support rail, wherein the electrical devices on the support rail can be attached to one another in order to create an electrical installation for providing different electrical or electronic functions.

For example, the first plug-in connector part can be fixedly connected to the housing of the electrical device. On the other hand, terminal devices can be arranged on the second plug-in connector part in the manner of screw terminals or spring force terminals via which electrical conductors can be connected to the second plug-in connector part. Electrical conductors can thus be connected to the electrical device via a plug-in connection by connecting the second plug-in connector part to the first plug-in connector part on the side of the electrical device in a plug-in manner.

In an embodiment, the invention also provides a method for encoding a plug-in connector system. The plug-in connector system includes a first plug-in connector part and a second plug-in connector part which can be connected together along a plug-in direction. In the method, a first encoding part and a second encoding part of an encoding device are arranged together on the second plug-in connector part in a pre-assembly position, and then the first plug-in connector part and the second plug-in connector part are connected to each other, wherein when the first plug-in connector part and the second plug-in connector part are connected to each other, the first encoding part engages with the first plug-in connector part and remains on the first plug-in connector part when the first plug-in connector part and the second plug-in connector part are detached from each another. In this case, it is provided that one of the first plug-in connector part and the second encoding part has a locking section and an insertion opening, and the other of the second plug-in connector part and the second encoding part comprises a locking element, the locking element being guided through the insertion opening along the plug-in direction and the locking element being brought into form-fitting engagement with the locking section by rotation of the second encoding part and the second plug-in connector part relative to one another.

The advantages and advantageous embodiments described above for the plug-in connector system also apply analogously to the method, so that reference should be made to the above statements in this regard.

Figure 2:
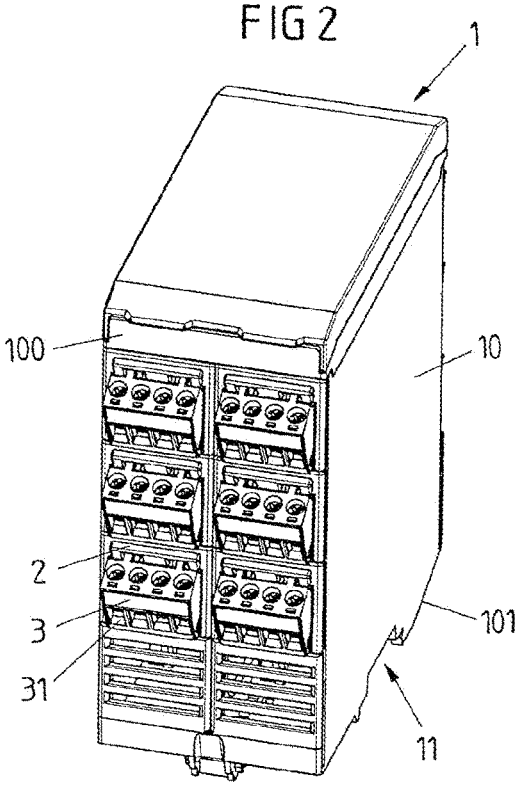
FIG. 2 a view of another exemplary embodiment of an electrical device.

FIGS. 1 and 2 show exemplary embodiments of two different electrical devices 1, each having a housing 10 and a fastening device 11 formed on a bottom side 101 of the housing 10 for arranging the electrical device 1 on a support rail. In the housing 10, for example, an electrical or electronic assembly, for example in the form of a printed circuit board with electrical or electronic components arranged thereon, can be accommodated, so that by arranging in sequence a plurality of electrical devices 1 on a support rail, a combination of electrical devices 1 with different electrical or electronic functions can be created.

In the exemplary embodiment of FIG. 1, first plug-in connector parts 2 are arranged on an end face 100 of the housing 10 to which second plug-in connector parts 3 are attached in a plug-in manner. The second plug-in connector parts 3 have a plurality of terminal devices 31 (in the illustrated embodiment, these take the form of screw terminals) via which electrical conductors can be connected to the plug-in connector part 3 and through it to the electrical device 1.

In the exemplary embodiment of FIG. 1, each second plug-in connector part 34 has plug-in openings with an associated terminal device 31 in each case. Each second plug-in connector part 3 can be connected to an associated first plug-in connector part 2 fixedly connected to the housing 10 in order in this way to connect electrical lines connected to the second plug-in connector part 3 to the electrical device 1.

In the exemplary embodiment shown in FIG. 1, each end face 100 of the housing 10 has arranged on it three second plug-in connector parts 2 arranged one above the other to which a second plug-in connector part 3 can be connected in each case.

In the exemplary embodiment in FIG. 2, in comparison with the exemplary embodiment according to FIG. 1, two rows of plug-in connector parts 2, 3 are arranged next to one another on the end face 100 of the housing 10. The electrical device 1 according to the exemplary embodiment according to FIG. 2 has a double width, but is otherwise functionally—in particular with regard to the plug-in connector parts 2, 3 to be connected to one another—identical to the exemplary embodiment according to FIG. 1.

Figure 3A:
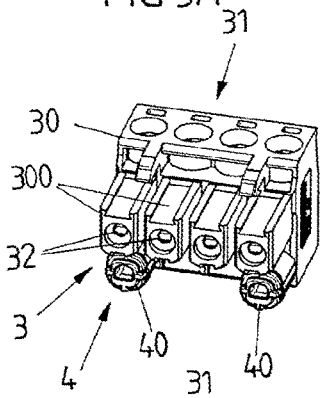
FIG. 3A a view of an exemplary embodiment of a plug-in connector part.
Figure 3B:
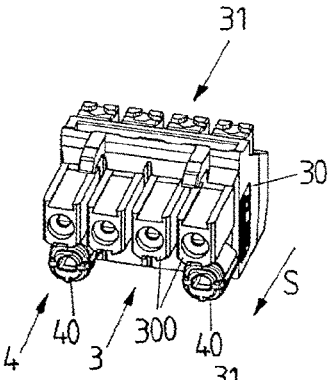
FIG. 3B a view of another exemplary embodiment of a plug-in connector part.
Figure 3C:
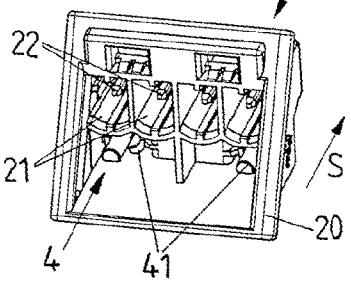
FIG. 3C a view of a plug-in connector part to which the plug-in connector part of FIG. 3A or 3B can be joined.

FIGS. 3A and 3B show two different exemplary embodiments of a second plug-in connector part 3 which can be connected in a plug-in manner to an associated first plug-in connector part 2 illustrated in FIG. 3C along a plug-in direction S.

In the exemplary embodiment of FIG. 3A, four terminal devices 31 in the form of screw terminals are arranged next to one another and allow the connection of four electrical lines for electrical contact with electrical contact elements 32 arranged on plug-in sections 300. The plug-in sections 300 are formed like plugs on a body 30 of the plug-in connector part 3 and protrude along the plug-in direction S.

In the exemplary embodiment in FIG. 3B, the terminal devices 31 are in contrast designed as spring force terminals. However, the exemplary embodiment in FIG. 3B is identical to the exemplary embodiment according to FIG. 3A in respect to the plug-in sections 300 and the electrical contact elements 32 arranged thereon.

The first plug-in connector part 2 according to FIG. 3C has four plug-in openings 21 in a series into which the plug-in sections 300 for the plug-in connection of the plug-in connector parts 2, 3 can be inserted. In each plug-in opening 21 an electrical contact element 22 is arranged, which is in contact, for example, with a printed circuit board mounted in the housing 10 of an associated electrical device 1 and with electrical or electronic components arranged thereon.

Figure 4A:
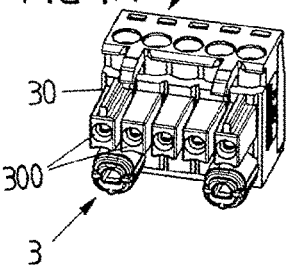
FIG. 4A a view of an exemplary embodiment of a plug-in connector part.
Figure 4B:
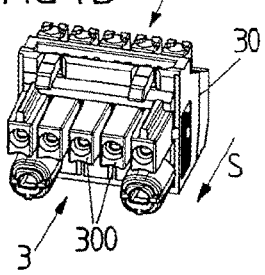
FIG. 4B a view of another exemplary embodiment of a plug-in connector part.
Figure 4C:
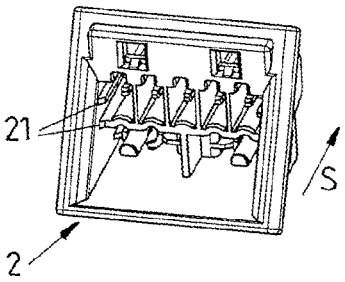
FIG. 4C a view of a plug-in connector part to which the plug-in connector part of FIG. 4A or 4B can be joined.

While in the examples of the second plug-in connector parts 3 which are shown in FIGS. 3A and 3B, four plug-in sections 300 are formed on the body 30 in each case, in the exemplary embodiment according to FIGS. 4A and 4B, five adjacent plug-in sections 300 with contact elements arranged thereon are provided in each case which can be inserted into an associated first plug-in connector part 2 according to FIG. 4C and plug-in openings 21 formed thereon. Terminal devices 31 in the form of screw terminals are provided in the example in FIG. 4A, but in the form of spring force terminals in the example FIG. 4B, analogous to the examples in FIGS. 3A and 3B.

Electrical lines can be connected to associated first plug-in connector parts 2 on the side of an electrical device 1 via the second plug-in connector parts 3 of the exemplary embodiments according to FIGS. 1 to 4A-4C. In this case, it should be ensured that each second plug-in connector part 3 can be connected only to an associated first connector part 2, but not to any other one, in order to prevent incorrect wiring of electrical lines.

For this purpose, encoding devices 4 are provided in the plug-in connector parts 2, 3 which have encoding parts 40, 41 and provide such an encoding between the plug-in connector parts 2, 3 that only plug-in connector parts 2, 3 that are encoded to match one another can be connected to one another.

Figure 5:
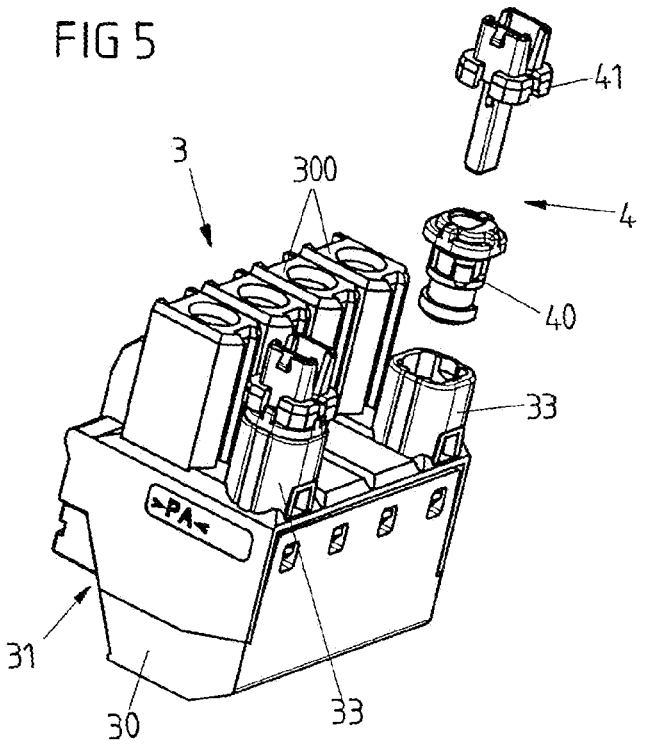
FIG. 5 a view of a plug-in connector part with encoding devices arranged thereon.
Figure 6:
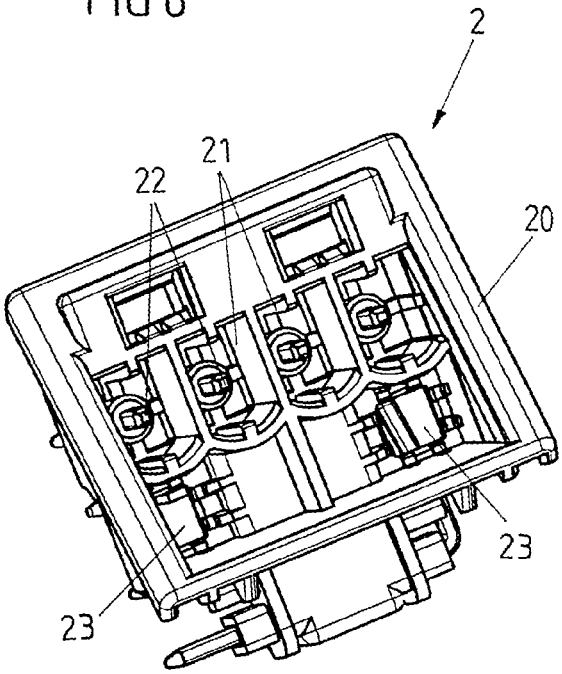
FIG. 6 a view of a plug-in connector part to which the plug-in connector part of FIG. 5 can be connected FIGS. 7A, 7B views of a first encoding part of an encoding device.

Each encoding device 4 is formed by two encoding parts 40, 41, as can be seen from FIG. 5. A first encoding part 41 is to be arranged on a receiving opening 23 on the body 20 of the first plug-in connector part 2, as can be seen from a viewing FIGS. 5 and 6 together, while a second encoding part 40 is to be attached to a socket 33 on the body 30 of the second plug-in connector part 3. In the illustrated examples, after the encoding has been produced two encoding parts 40, 41 are arranged on each plug-in connector part 2, 3, which ensure that only those plug-in connector parts 2, 3 which are encoded to precisely match one another can be joined to one another.

Figure 7A:
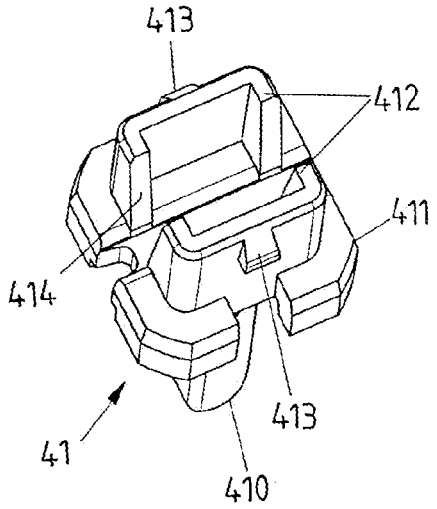
Figure 7B:
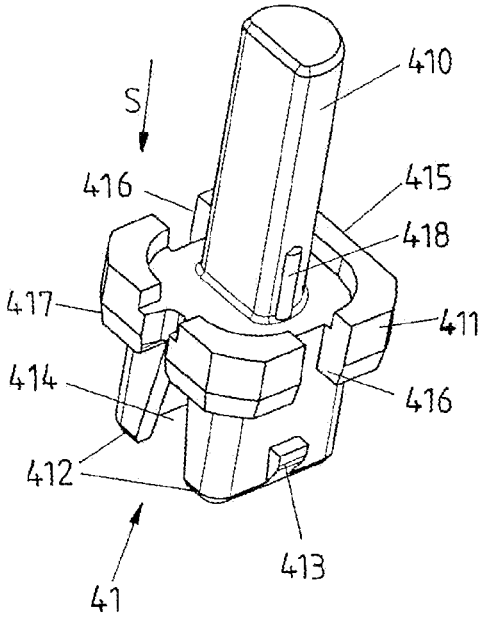

As can be seen from FIGS. 7A and 7B, the first encoding part 41 assigned to the first plug-in connector part 2 has an encoding shaft 410 which projects axially along the plug-in direction S from a collar 411 and has a non-rotationally symmetrical form.

On a side facing away from the encoding shaft 410, engagement sections 412 extend from the collar 411 and serve to engage in the receiving opening 23 of the first plug-in connector part 2 (see FIG. 6) and each carry a latching element 413 in the form of a latching projection projecting outward. A central engagement 414 is formed between the engagement sections 412 via which a user can access the encoding part 41 with a tool (see FIG. 22) in order to bring the encoding device 4 into a desired encoding position.

Two mutually opposite encoding elements 416 and a further encoding element 417 arranged between the encoding elements 416 in the form of encoding recesses are formed on the collar 411. An edge section 415 protrudes axially toward the encoding shaft 410 from the collar 411.

Figure 8A:
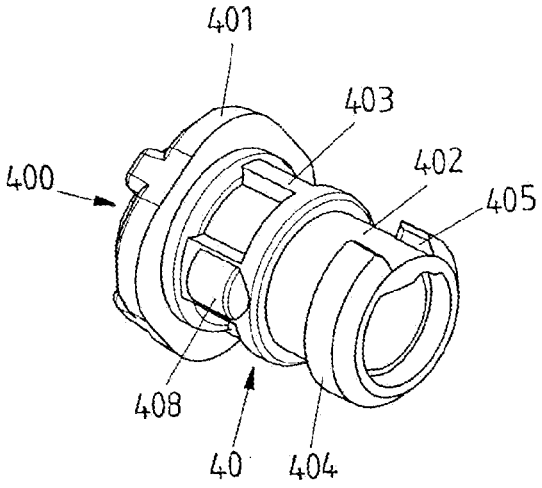
FIGS. 8A, 8B views of a second encoding part of an encoding device.
Figure 8B:
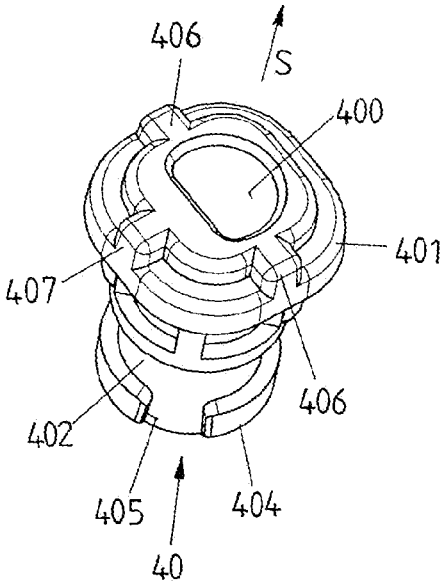

As can be seen from FIGS. 8A, 8B, the second encoding part 40 assigned to the second plug-in connector part 3 has an encoding opening 400 which is complementary to the encoding shaft 410 of the first encoding part 41 and into which the encoding shaft 410 of the first encoding part 41 can be joined in a plug-in manner. Protruding axially from a collar 401 is a connection shaft 402 on which a bearing section 403 is formed adjacent to the collar 401 and which bears a radially outwardly projecting locking section 404 at one end facing away from the collar 401 which, viewed along a circumferential direction about the plug-in direction S, is interrupted at one point by an insertion opening 405.

On the collar 401, on a side facing away from the connection shaft 402, encoding elements 406, 407 are formed in the form of encoding projections, of which two encoding elements 406 lie opposite one another and a third encoding element 407 is arranged between the encoding elements 406. The encoding elements 406, 407 are complementary to the encoding elements 416, 417 of the first encoding part 41 in such a way that the encoding elements 406, 407, 416, 417 can be matchingly engaged with each other when the encoding parts 40, 41 are connected (in a way corresponding to the encoding).

Diametrically opposed fitting sections 418 are formed on the encoding shaft 410 in the form of axially extending, outwardly projecting ridges that have an interference fit with the encoding opening 400. When connecting the encoding parts 40, 41 to one another, the encoding shaft 410 of the first encoding part 41 thus engages with the encoding opening 400 of the second encoding part 40 in an interference fit, so that the encoding parts 40, 41 are held together at least in a captive manner when in the joined state.

Figure 9:
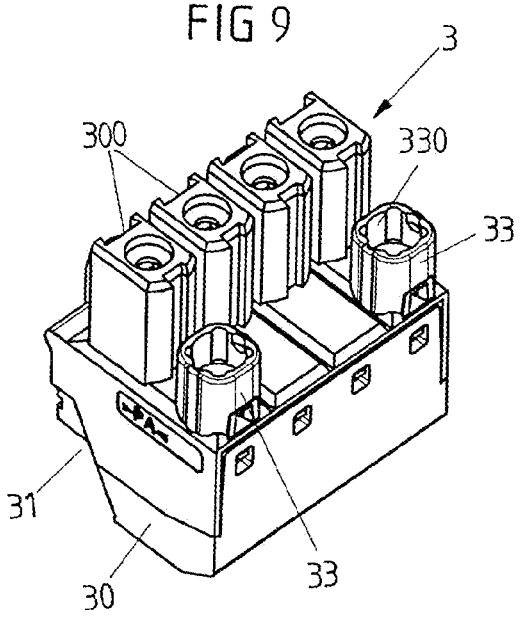
FIG. 9 a view of an exemplary embodiment of a plug-in connector part before connecting to encoding devices.
Figure 10A:
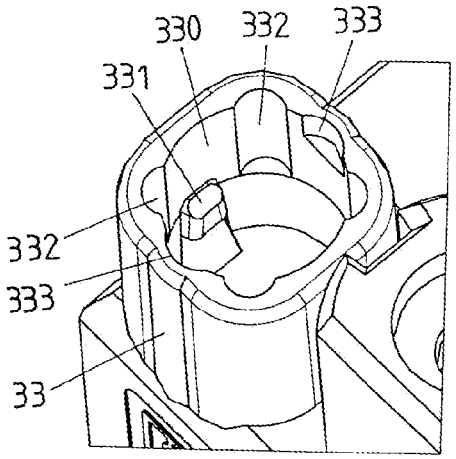
FIG. 10A, 10B enlarged views in the region of a socket of the plug-in connector part according to FIG. 9.
Figure 10B:
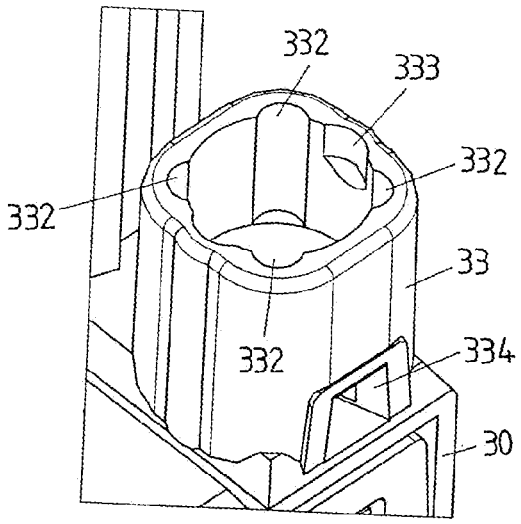
Figure 11:
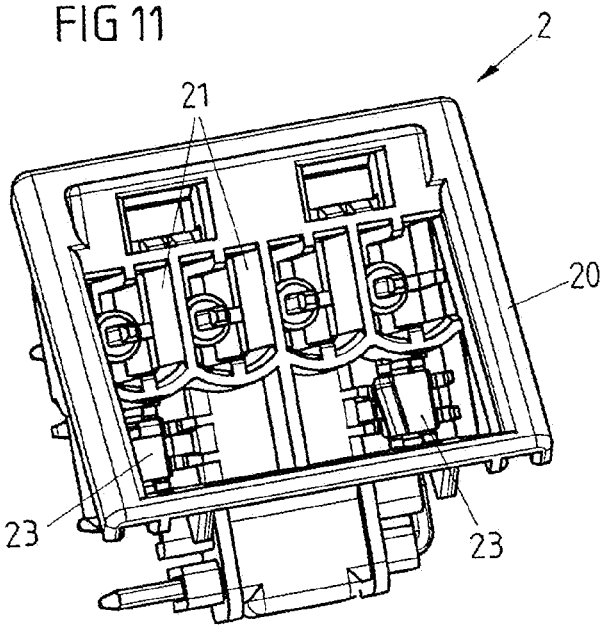
FIG. 11 a view of a plug-in connector part that can be connected to the plug-in connector part according to FIG. 9.
Figure 12A:
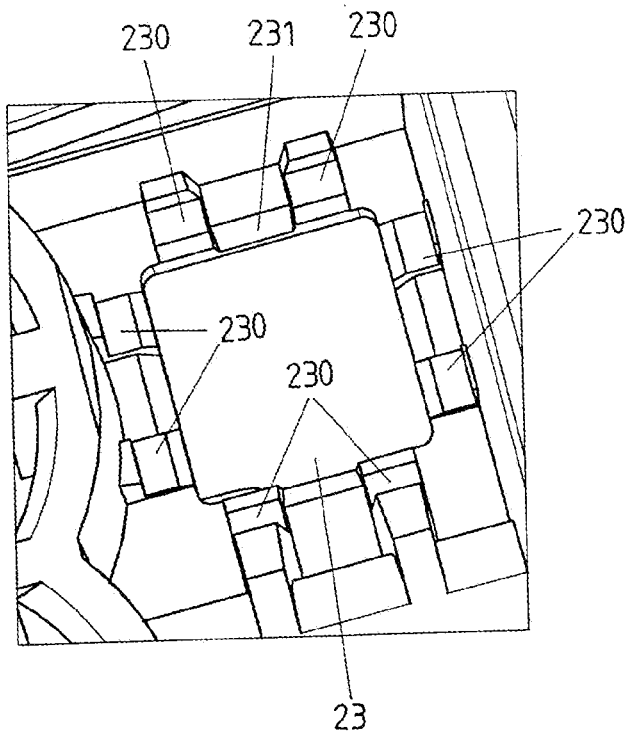
FIGS. 12A, 12B views in the region of a receiving opening of the plug-in connector part according to FIG. 11 for connection to a first encoding part of an encoding device.
Figure 12B:
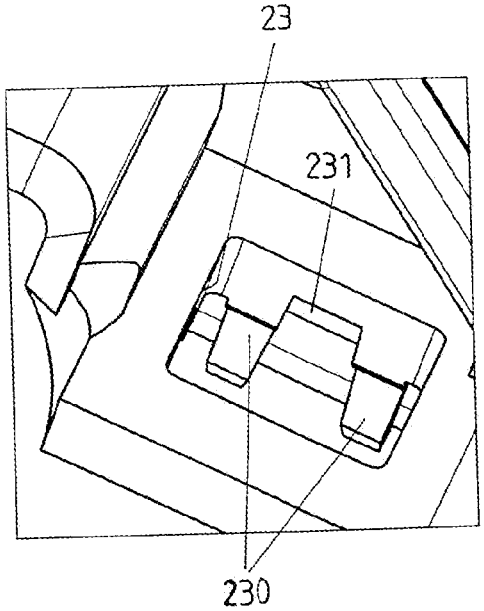

The second encoding part 40 is assigned to the second plug-in connector part 3 and is to be attached to a socket 33 on the body 30 of the plug-in connector part 3. As can be seen from FIGS. 9 and 10A, 10B, the socket 33 forms a connection opening 330 into which the encoding part 40 with its connection shaft 402 is to be inserted, wherein four latching devices 332 in the form of radially outwardly curved latching pockets and two exposed areas 333 are formed on the connection opening 330 as an insertion aid for the encoding part 40.

A locking element 331 protrudes radially inward into the connection opening 330 and serves for the locking connection of the second plug-in connector part 3 to the encoding part 40. Thus, the encoding part 40 is inserted into the connection opening 330 for connection such that the locking element 331 is passed through the insertion hole 405 of the locking section 404 until the locking section 404 has passed the locking element 131. By rotation, the encoding part 40 can then be fixed to the socket 33 in that the locking element 331 engages with the locking section 404 in a form-fitting manner.

At the outwardly facing edge of the connection opening 330, outwardly curved exposed areas 333 are formed which serve as insertion aids and can be used to engage latching devices 408 in the form of radially outwardly projecting latching projections on the bearing section 403 of the encoding part 40 in order to connect the encoding part 40 to the socket 33.

The latching devices 408 in the form of the latching projections interact with the latching devices 332 in the form of latching pockets in the interior of the connection opening 330 in order to hold the encoding part 40 in a latched position in the connection opening 330 in predetermined discrete rotational positions.

A viewing window 334 through which a user can visually inspect whether a connection between the encoding part 40 and the socket 33 has been established as intended is formed in a foot region of the socket 33.

The encoding part 41 is assigned to the first plug-in connector part 2 and is to be received in a receiving opening 23 on the body 20 of the plug-in connector part 2. On one side to which the encoding part 41 is to be attached, each receiving opening 23 of the plug-in connector part 2 is surrounded by a plurality of support elements 32 with which the collar 411 of the encoding part 41 comes into contact during connection. The latching elements 413 can run on the engagement sections 412 on an edge surrounding the receiving opening 23 via run-up slopes 231 in order to snap into latching engagement with the edge surrounding the receiving opening 23 and thus to produce a form-fitting connection between the encoding part 41 and the first plug-in connector part 2.

In order to produce an encoding between the plug-in connector parts 2, 3, an encoding device 4 is attached to each socket 33 on the body 30 of the second plug-in connector part 3, as can be seen from FIG. 5. In a pre-assembly position, the encoding devices 4 are in this case attached to an associated socket 33 together with the encoding parts 40, 41 and connected to the socket 33 via the encoding part 40.

Figure 13A:
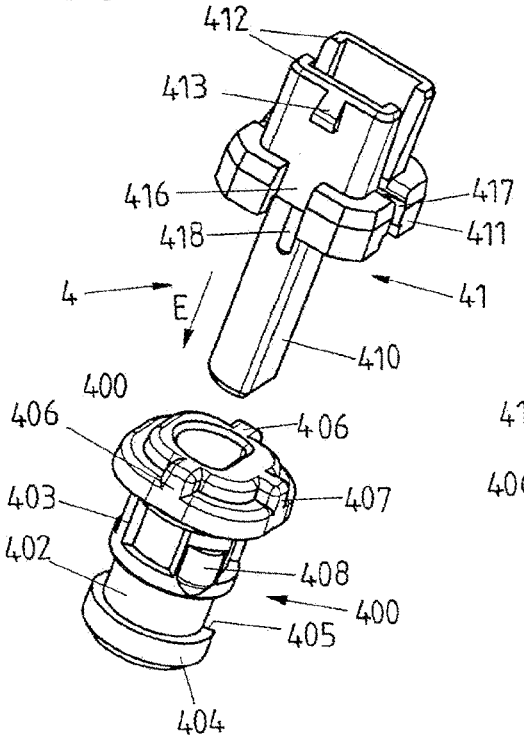
FIG. 13A a view of the encoding device prior to connecting the encoding parts together.
Figure 13B:
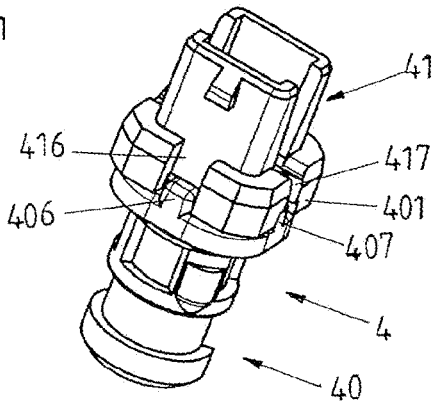
FIG. 13B a view of the encoding device with encoding parts joined to one another.
Figure 14A:
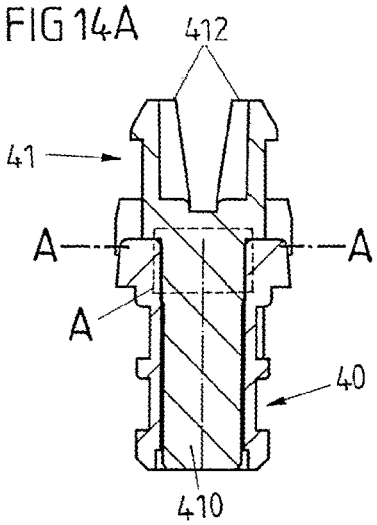
FIG. 14A a longitudinal sectional view through the encoding device in the joined position according to FIG. 13B.
Figure 15A:
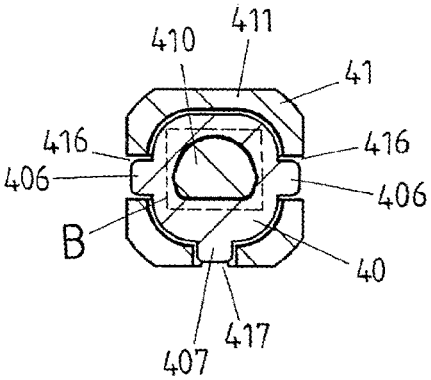
FIG. 15A a sectional view along line A-A according to FIG. 14A.
Figure 14B:
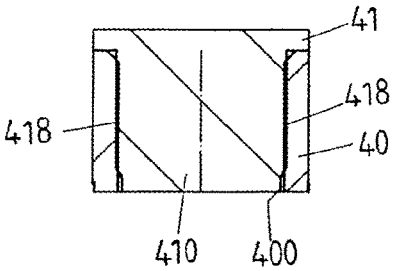
FIG. 14B an enlarged view in a cutout A according to FIG. 14A.
Figure 15B:
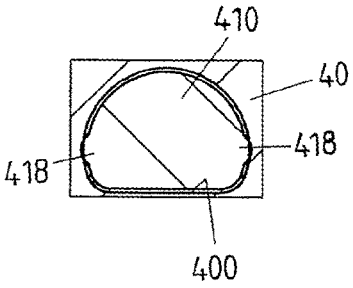
FIG. 15B an enlarged view in a cutout B according to FIG. 15A.

As can be seen from FIGS. 13A and 13B, in order to transition to the pre-assembly position, the encoding sections 40, 41 are joined together along a connection direction E in that the encoding shaft 410 engages with the encoding opening 400. The encoding elements 406, 407, 416, 417 also engage with one another at the collars 401, 411 so that the encoding parts 40, 41 are held non-rotationally fixed to one another, as can be seen from FIG. 13B.

In the joined state, the fitting sections 418 are inserted in the encoding opening 401 with an interference fit, as can be seen from FIGS. 14A, 14B and 15A, 15B. The encoding parts 40, 41 are held against each other in a force-fitting manner at least in a captive manner.

Figure 16A:
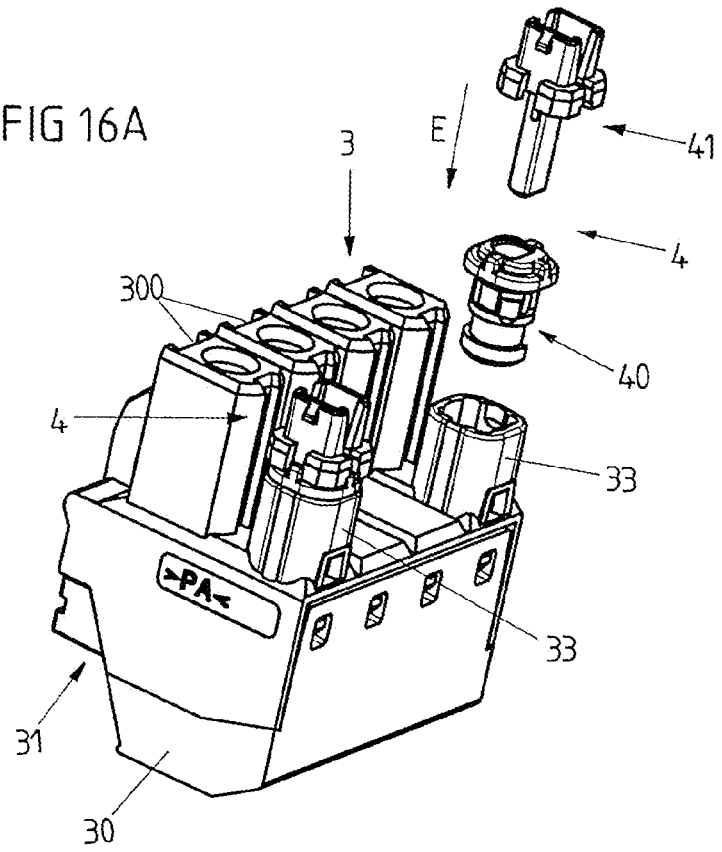
FIG. 16A a view of a plug-in connector part with encoding devices to be disposed thereon.
Figure 16B:
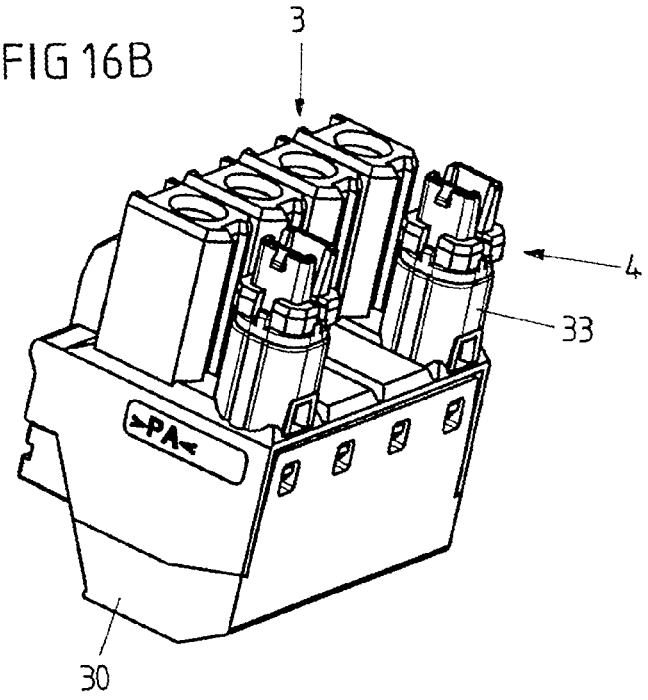
FIG. 16B a view of the plug-in connector part with joined encoding devices disposed thereon.

In this joined state, the encoding devices 4 are attached to the plug-in connector part 3, as can be seen from FIG. 16B, by inserting the encoding parts 40 into the sockets 33 and connecting them firmly to the sockets 33 by rotation. When connecting, the locking sections 404 of the encoding parts 40 engage the locking elements 331 in the interior of the sockets 33 in a form-fitting manner, so that a bayonet-type connection is produced between the encoding devices 4 and the plug-in connector part 3 in this way.

FIGS. 17 to 20A-20 C illustrate the connection process for connecting an encoding device 4 to an associated socket 33 of the plug-in connector part 3.

Figure 17:
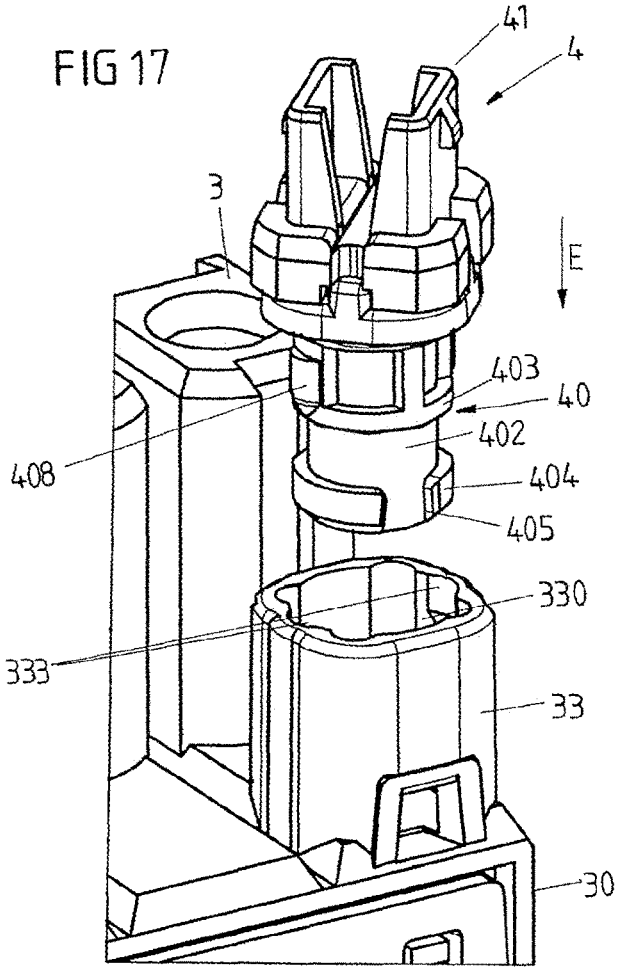
FIG. 17 an enlarged view of an encoding device prior to connecting to a plug-in connector part.
Figure 18A:
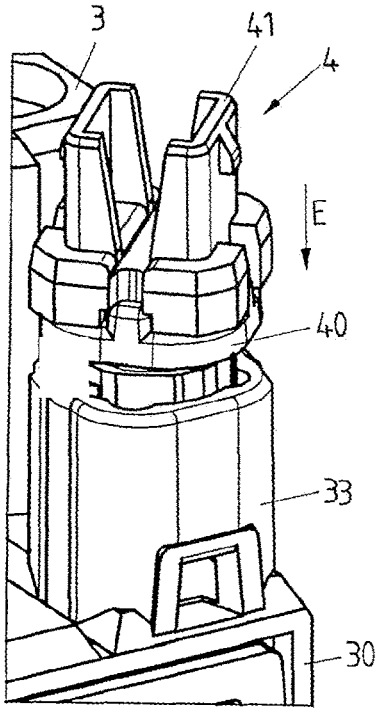
FIG. 18A a view of the encoding device at the time of connecting.
Figure 18B:
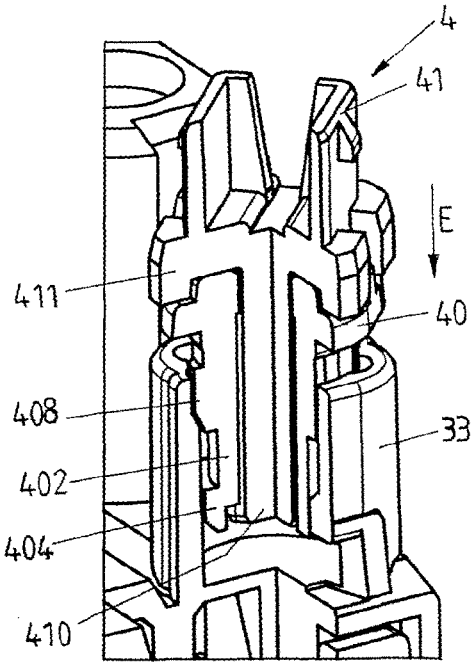
FIG. 18B a partial sectional view in the position of the encoding device according to FIG. 18A.
Figure 18C:
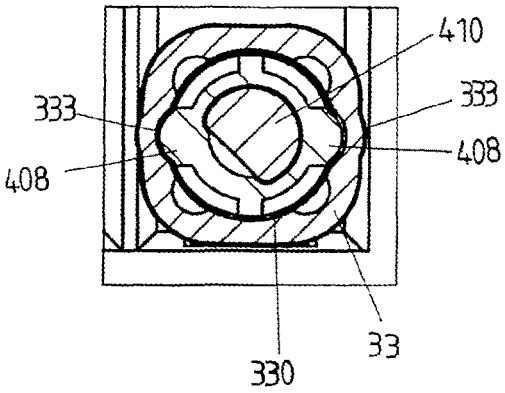
FIG. 18C a cross-sectional view of the encoding device in the position according to FIG. 18A.
Figure 19A:
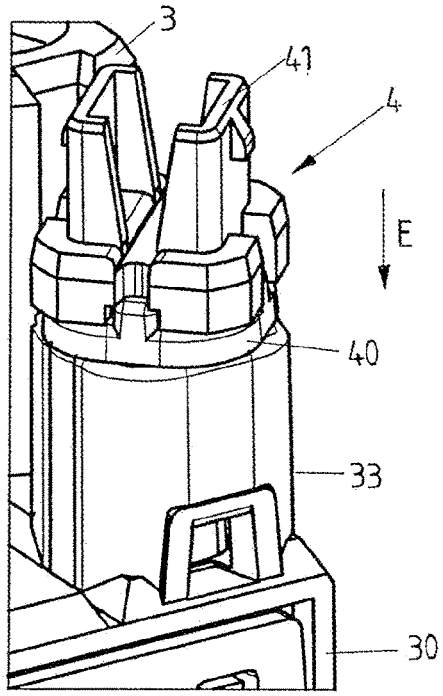
FIG. 19A a view of the encoding device at the time of connecting.
Figure 19B:
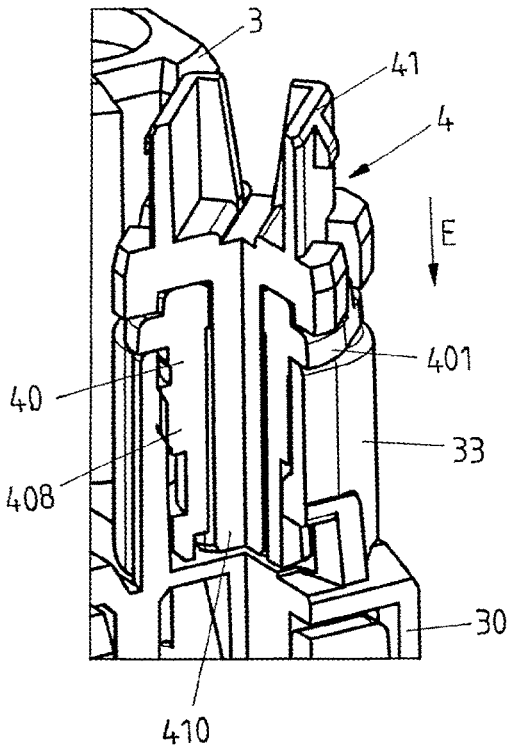
FIG. 19B a partial sectional view in the position of the encoding device according to FIG. 19A.
Figure 19C:
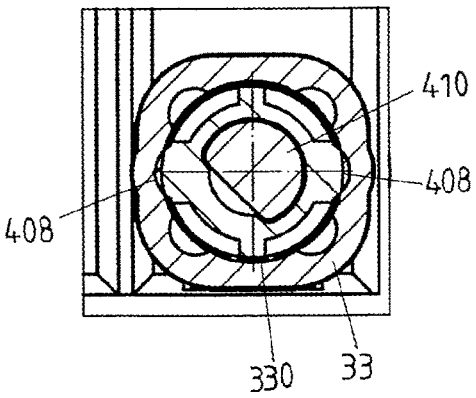
FIG. 19C a cross-sectional view of the encoding device in the position according to FIG. 19A.

As can be seen from FIG. 17 in the transition to FIGS. 18A-18C, when the connection shaft 402 of the encoding part 40 is inserted into the connection opening 330 of the socket 33, the latching devices 408 in the form of the latching projections projecting outwardly are first brought into engagement with the exposed area 333 at the outer edge of the connection opening 330. This takes place in a position in which the insertion opening 405 at the locking portion 404 is aligned with the locking element 331 in the interior of the connection opening 330 so that the locking element 331 can be passed through the insertion opening 405 and the locking section 404 thus passes the locking element 331 in the connection direction E, as can be seen from FIGS. 19A-19C.

Figure 20A:
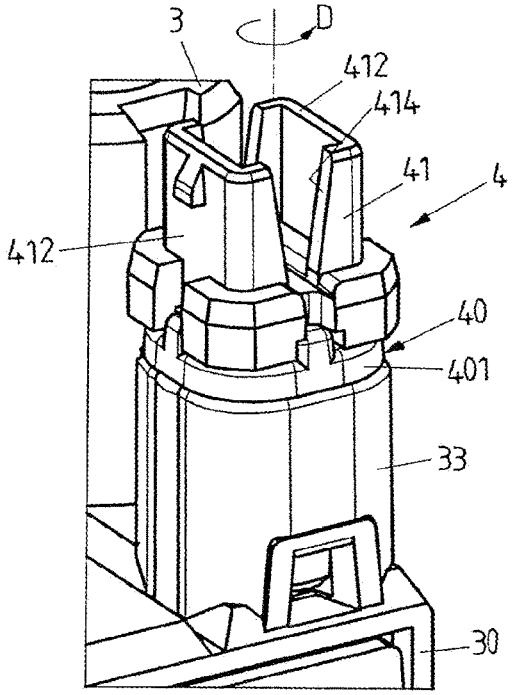
FIG. 20A a cross-sectional view of the encoding device in connected position.
Figure 20B:
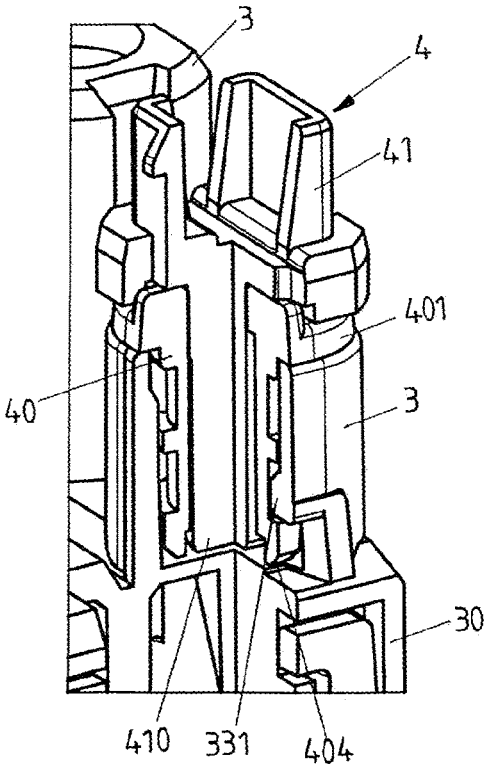
FIG. 20B a partial sectional view in the position of the encoding device according to FIG. 20A.
Figure 20C:
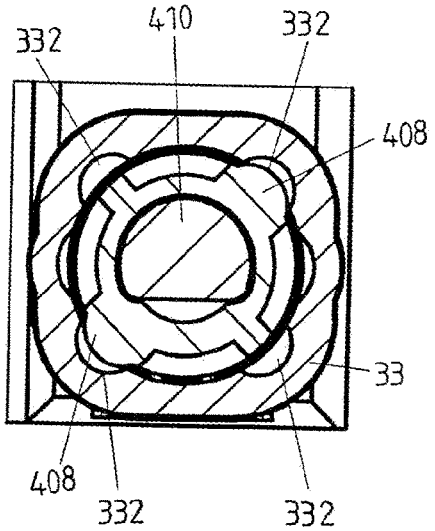
FIG. 20C a cross-sectional view of the encoding device in the position according to FIG. 20A.
Figure 21A:
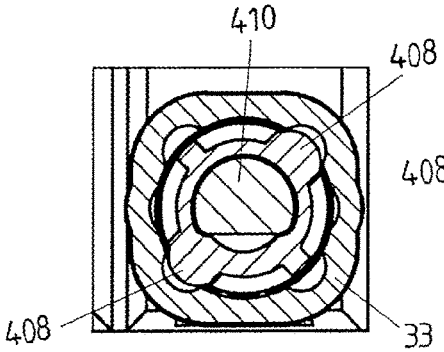
FIG. 21A-D views of the encoding device in different encoding positions.
Figure 21B:
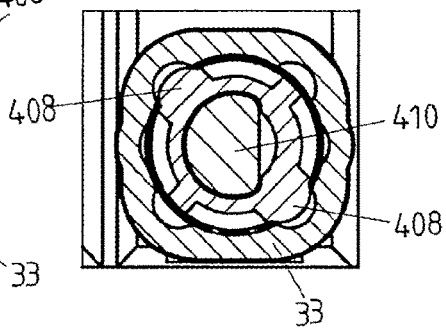
Figure 21C:
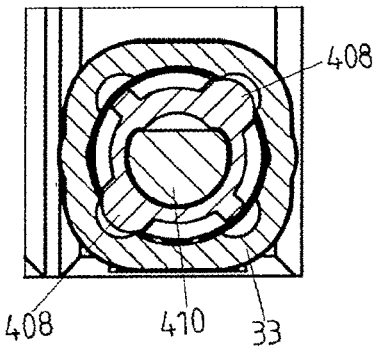
Figure 21D:
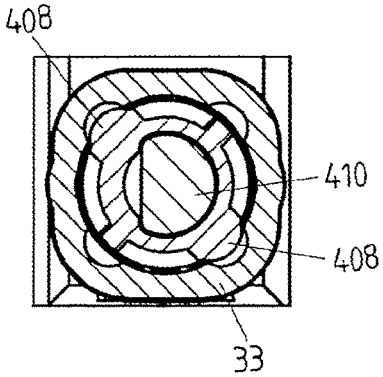
Figure 22:
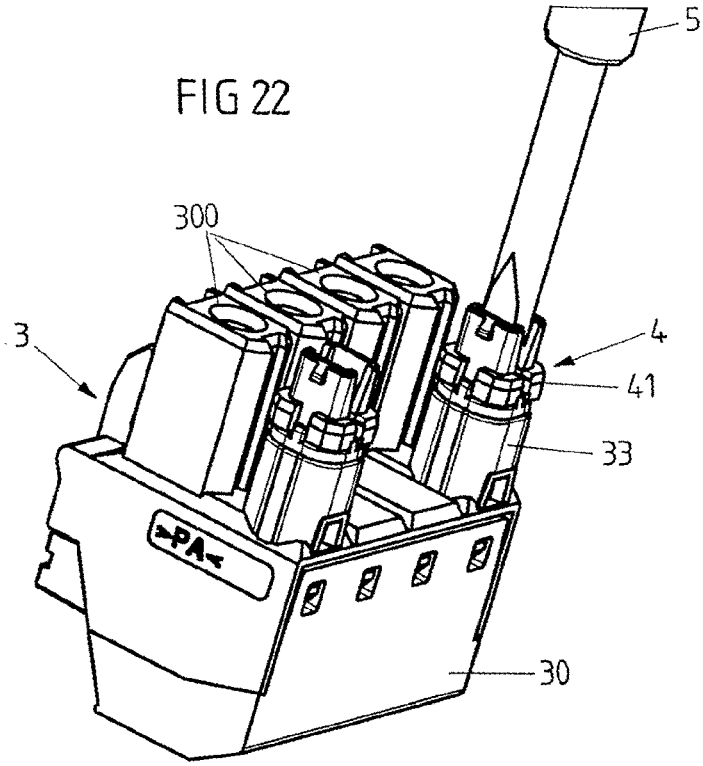
FIG. 22 a view of a plug-in connector part with encoding devices disposed thereon, together with a tool for adjusting an encoding device.

The encoding device 4 can now be rotated as a whole—by placing a tool 5 in the form of a screwdriver into the central engagement 414 between the engagement sections 412 as shown in FIG. 22—in a rotational direction D, as a result of which the locking section 404 engages with the locking element 331 in a form-fitting manner and the encoding device 4 is thus locked on the socket 33 as can be seen from FIGS. 20A-20C. In this case, the encoding part 40 is brought into a rotational position relative to the socket 33 in which the latching projections 408 are in engagement with a pair of opposing latching pockets 332 in the interior of the connection opening 330. In such a predefined rotational position, the encoding part 40 and through it the encoding device 4 are held in a latched position on the socket 33.

As can be seen from FIGS. 21A to 21D, the encoding device 4 can be brought into four different rotational positions, which are angularly spaced apart from one another by 90°. These different rotational positions define discrete encoding positions which bring about an encoding between the encoding parts 40, 41 and thus between the plug-in connector parts 2, 3.

Figure 23:
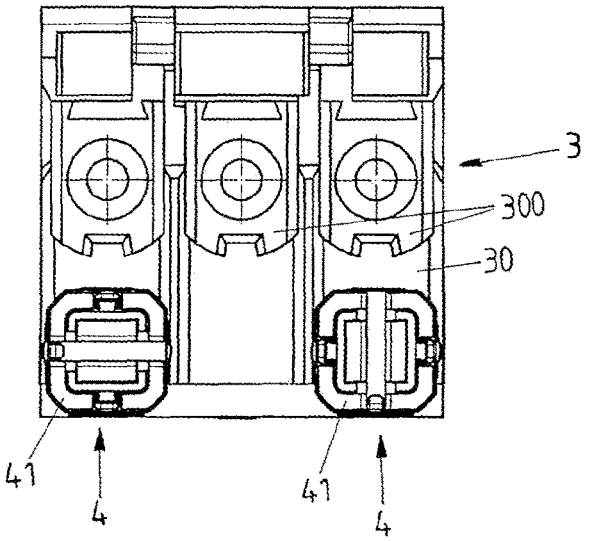
FIG. 23 a view of a plug-in connector part with encoding devices arranged thereon.
Figure 24:
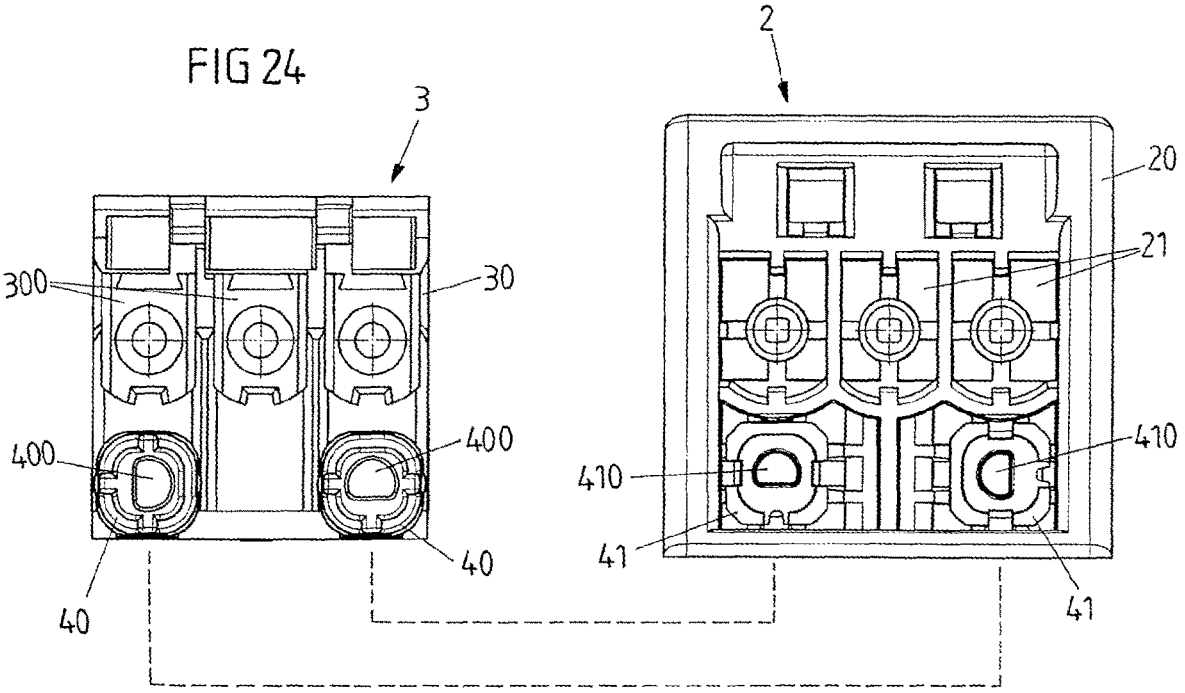
FIG. 24 a view of the plug-in connector part with encoding parts of the encoding devices arranged thereon, together with a further plug-in connector part with encoding parts arranged thereon.

When the encoding devices 4 on a plug-in connector part 3 have been brought into a desired position, as is illustrated by way of example in FIG. 23, the plug-in connector parts 2, 3 are connected to one another in a plug-in manner along the plug-in direction S and then, as can be seen from FIG. 24, separated from one another again, so that two encoding parts 40, 41 remain on each plug-in connector part 2, 3.

Figure 27A:
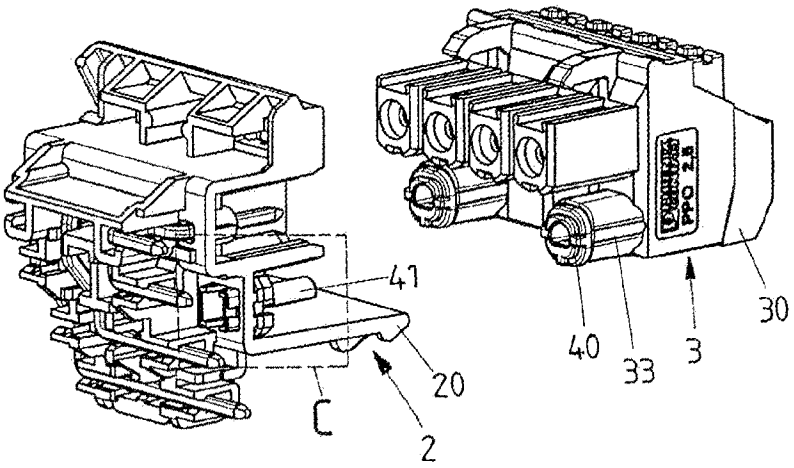
FIG. 27A a view of the plug-in connector parts after encoding has been created.
Figure 27B:
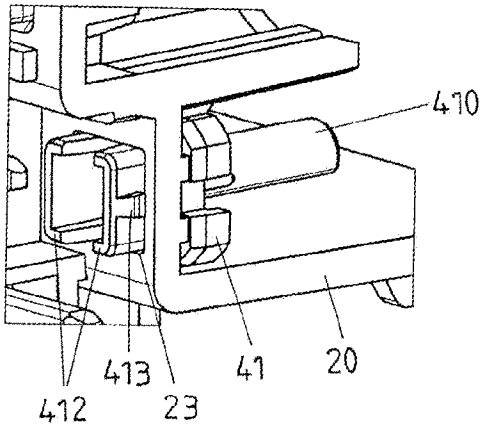
FIG. 27B an enlarged view in a cutout C according to FIG. 27A.
Figure 25:
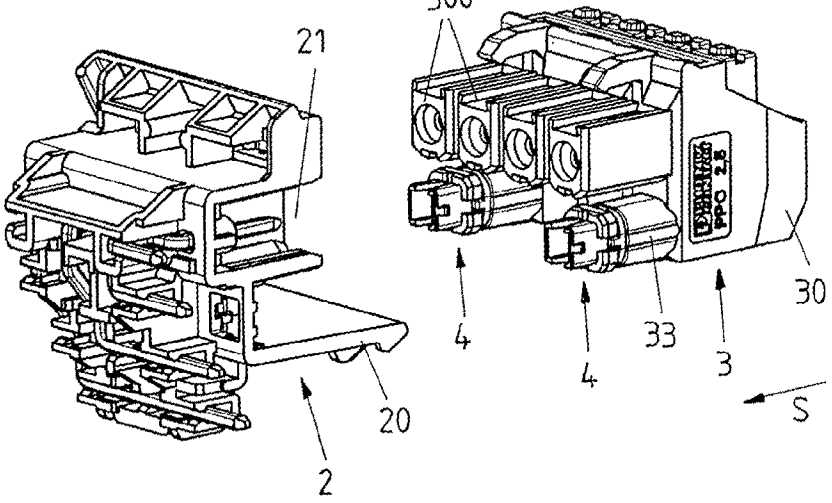
FIG. 25 a view of two plug-in connector parts prior to the creation of the encoding.
Figure 26:
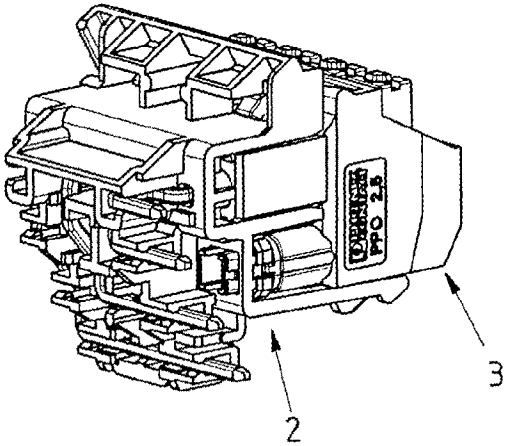
FIG. 26 a view of the plug-in connector parts during creation of the encoding.

As shown by way of example in FIGS. 25 and 26 for a pair of plug-in connector parts 2, 3, the encoding parts 41 of the encoding devices 4 engage with the associated receiving openings 23 on the plug-in connector part 2 when the plug-in connector parts 2, 3 are connected in a plug-in manner and latch in these receiving openings 23 so that when the plug-in connector parts 2, 3 are detached from one another again, shown in FIGS. 27A and 27B, the encoding parts 41 remain on the plug-in connector part 2.

If the plug-in connector parts 2, 3 are to be connected to one another again, this is only possible with correct encoding. Thus, only mutually encoded, mutually associated plug-in connector parts 2, 3 can be joined to one another, namely those plug-in connector parts 2, 3 in which the encoding parts 41 on the plug-in connector part 2 fit into the encoding parts 40 on the plug-in connector part 3.

For each encoding device 4, the encoding shaft 410 and the encoding opening 400 provide a primary encoding, which allows the encoding parts 40, 41 to be joined in a matching orientation and interact first during a plug-in process. The encoding elements 406, 407, 416, 417 on the collars 401, 411 provide a secondary encoding and can likewise only be joined together in a matching orientation, but in particular also serve to visualize the rotational position of the encoding parts 40, 41 for a user, so that a user can easily recognize whether an encoding is appropriate and plug-in connector parts 2, 3 can be joined to one another or not.

The idea underlying the invention is not limited to the exemplary embodiments described above, but can in principle be realized in a different manner.

In particular, encoding devices of the type described are not restricted to use on plug-in connector parts of the designs illustrated in the figures, but can be used on any desired plug-in connector parts which are to be connected to one another. In this respect, the use of such an encoding device is also not limited to the connection of lines to an electrical device to be arranged on a support rail.

In this case, one, two or even more encoding devices can be used on two plug-in connector parts. By using a plurality of encoding devices, the encoding possibilities can be broadened so that a larger number of plug-in connector parts can be distinguished in the encoding.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Electrical device
10 Housing
100 End face
101 Base
11 Fastening device
2 Mating plug-in connector
20 Body
21 Insertion opening
22 Contact element
23 Receiving opening
230 Support element
231 Run-up slope
3 Plug-in connector
30 Body
300 Plug-in sections
31 Terminal device
32 Contact element
33 Socket
330 Connection opening
331 Locking element
332 Latching device (latching pocket)
333 Exposed area (insertion aid)
334 Viewing window
4 Encoding device
40 Encoding part
400 Encoding opening
401 Collar
402 Connection shaft
403 Bearing section
404 Locking section
405 Insertion opening
406, 407 Encoding element (engaging element)
408 Latching element (latching projection)
41 Encoding part
410 Encoding shaft
411 Collar
412 Engaging section
413 Latching element
414 Center engagement
415 Edge section
416, 417 Encoding element (recess)
418 Fitting section
5 Tool
D Direction of rotation
E Connection direction
S Plug-in direction

The invention claimed is:

1. A plug-in connector system, comprising:

a first plug-in connector part and a second plug-in connector part, which are connectable to one another in a plug-in manner along a plug-in direction; and an encoding device having a first encoding part connectable to the first plug-in connector part and a second encoding part connectable to the second plug-in connector part, wherein the first encoding part and the second encoding part are arrangeable together on the second plug-in connector part in a pre-assembly position and the first encoding part is configured to connect with the first plug-in connector part during connecting of the first plug-in connector part and the second plug-in connector part and to remain on the first plug-in connector part during detaching of the first plug-in connector part and the second plug-in connector part from each other, wherein one of the second plug-in connector part and the second encoding part has a locking section and an insertion opening and an other of the second plug-in connector part and the second encoding part has a locking element, and wherein for connecting the second encoding part to the second plug-in connector part, the locking element is guidable through the insertion opening along the plug-in direction and the locking element is configured to be brought into form-fitting engagement with the locking section by rotation of the second encoding part and the second plug-in connector part relative to one another.

2. The plug-in connector system according to claim 1, wherein the locking section extends in a ring shape, and wherein the insertion opening interrupts the locking section at one point when viewed along a circumferential direction about the plug-in direction.

3. The plug-in connector system according to claim 1, wherein the second encoding part has a first latching device and the second plug-in connector part has a second latching device, and wherein the first latching device and the second latching device together define a plurality of discrete rotational positions which are angularly spaced apart from one another about the plug-in direction, in which rotational positions the second encoding part and the second plug-in connector part are held latched together.

4. The plug-in connector system according to claim 1, wherein the first encoding part and the second encoding part are joinable together along the plug-in direction at a predetermined angular position relative to one another.

5. An electrical device having the plug-in connector system according to claim 1.

6. The plug-in connector system according to claim 1, wherein the second plug-in connector part or the second encoding part has a connection shaft and the respective other part has a connection opening into which the connection shaft is insertable.

7. The plug-in connector system according to claim 6, wherein the locking section is arranged on the connection shaft and protrudes from the connection shaft radially to the plug-in direction.

8. The plug-in connector system according to claim 1, wherein one of the encoding parts has an encoding shaft and an other of the encoding parts has an encoding opening, and wherein the encoding shaft is joinable with the encoding opening along the plug-in direction at a predetermined angular position.

9. The plug-in connector system according to claim 8, wherein the encoding shaft comprises at least one fitting section with an interference fit with the encoding opening.

10. The plug-in connector system according to claim 1, wherein the first encoding part has at least one latching element for a latching connection to the first plug-in connector part.

11. The plug-in connector system according to claim 10, wherein the first encoding part has at least one engagement section which is configured to be brought into engagement with a receiving opening of the first plug-in connector part and on which the at least one latching element is arranged.

12. A method for encoding a plug-in connector system having a first plug-in connector part and a second plug-in connector part which are connectable to one another in a plug-in manner along a plug-in direction, comprising:

arranging together a first encoding part and a second encoding part of an encoding device on the second plug-in connector part in a pre-assembly position so as to connect the first plug-in connector part and the second plug-in connector part to each other, the first encoding part entering into a connection with the first plug-in connector part during connection of the first plug-in connector part and the second plug-in connector part to each other, the first encoding part remaining on the first plug-in connector part during detaching of the first plug-in connector part and the second plug-in connector part from each other, wherein one of the second plug-in connector part and the second encoding part has a locking section and an insertion opening and an other of the second plug-in connector part and the second encoding part has a locking element, and wherein for connecting the second encoding part to the second plug-in connector part, the locking element is guided through the insertion opening along the plug-in direction and the locking element is brought into form-fitting engagement with the locking section by rotation of the second encoding part and the second plug-in connector part relative to one another.

13. A plug-in connector system, comprising:

a first plug-in connector part and a second plug-in connector part, which are connectable to one another in a plug-in manner along a plug-in direction; and an encoding device having a first encoding part connectable to the first plug-in connector part and a second encoding part connectable to the second plug-in connector part, wherein the first encoding part and the second encoding part are arrangeable together on the second plug-in connector part in a pre-assembly position and the first encoding part is configured to connect with the first plug-in connector part during connecting of the first plug-in connector part and the second plug-in connector part and to remain on the first plug-in connector part during detaching of the first plug-in connector part and the second plug-in connector part from each other, wherein one of the second plug-in connector part and the second encoding part has a locking section and an insertion opening and an other of the second plug-in connector part and the second encoding part has a locking element, wherein for connecting the second encoding part to the second plug-in connector part, the locking element is guidable through the insertion opening along the plug-in direction and the locking element is configured to be brought into form-fitting engagement with the locking section by rotation of the second encoding part and the second plug-in connector part relative to one another, wherein the first encoding part has a first collar with at least one first encoding element formed thereon and the second encoding part has a second collar with at least one second encoding element formed thereon, and wherein the first encoding element and the second encoding element are joinable together along the plug-in direction at a predetermined angular position.

14. A plug-in connector system, comprising:

a first plug-in connector part and a second plug-in connector part, which are connectable to one another in a plug-in manner along a plug-in direction; and an encoding device having a first encoding part connectable to the first plug-in connector part and a second encoding part connectable to the second plug-in connector part, wherein the first encoding part and the second encoding part are arrangeable together on the second plug-in connector part in a pre-assembly position and the first encoding part is configured to connect with the first plug-in connector part during connecting of the first plug-in connector part and the second plug-in connector part and to remain on the first plug-in connector part during detaching of the first plug-in connector part and the second plug-in connector part from each other, wherein one of the second plug-in connector part and the second encoding part has a locking section and an insertion opening and an other of the second plug-in connector part and the second encoding part has a locking element, wherein for connecting the second encoding part to the second plug-in connector part, the locking element is guidable through the insertion opening along the plug-in direction and the locking element is configured to be brought into form-fitting engagement with the locking section by rotation of the second encoding part and the second plug-in connector part relative to one another, wherein one of the plug-in connector parts has at least one plug-in section with an electrical contact element arranged thereon and an other of the plug-in connector parts has at least one plug-in opening having an electrical contact element arranged thereon, and wherein the at least one plug-in section is connectable to the at least one plug-in opening to connect the plug-in connector parts to each another.

* * * * *